United States Patent [19]

Beatriz et al.

[11] Patent Number: 4,565,020

[45] Date of Patent: Jan. 21, 1986

[54] FABRIC STRETCHING DEVICE

[76] Inventors: Dulce Beatriz; Leonardo Beatriz, both of Dade County, Fla.

[21] Appl. No.: 535,665

[22] Filed: Sep. 27, 1983

Related U.S. Application Data

[63] Continuation-in-part of Ser. No. 263,782, May 14, 1981, abandoned.

[51] Int. Cl.[4] ..... D06C 3/08

[52] U.S. Cl. ..... 38/102.5; 160/374.1

[58] Field of Search ..... 38/102.6, 102.5; 160/374.1, 378, 381

[56] References Cited

U.S. PATENT DOCUMENTS

| | | | |
|---|---|---|---|
| 602,353 | 4/1898 | Nunns . | |
| 1,562,153 | 11/1925 | Elbern | 160/374.1 |
| 3,012,362 | 12/1961 | Blinderman . | |
| 4,301,853 | 11/1981 | Vidal | 38/102.5 X |
| 4,432,150 | 2/1984 | Swonger | 38/102.5 |

*Primary Examiner*—Werner H. Schroeder
*Assistant Examiner*—Andrew M. Falik
*Attorney, Agent, or Firm*—Jesus Sanchelima

[57] ABSTRACT

A tensioning device for the corner joints of a fabric stretcher that provides for incremental movement of each stretcher member at the corner joint for mitered, butt-end, or overlapping corner joints. The device includes first and second rigid channels each shaped in a right angle joined end to end to form a corner joint support. Each rigid member includes elongated apertures through which fasteners allow for rigid connection of the device to the stretcher members. Tensioning devices such as bolts or screws protrude through the bottom support members on each side to allow for individual tensioning against the frame member. In one embodiment the first and second right angled channels are themselves offset from the plane of the stretched fabric through the back support members to allow for lean-in of the stretcher members.

3 Claims, 13 Drawing Figures

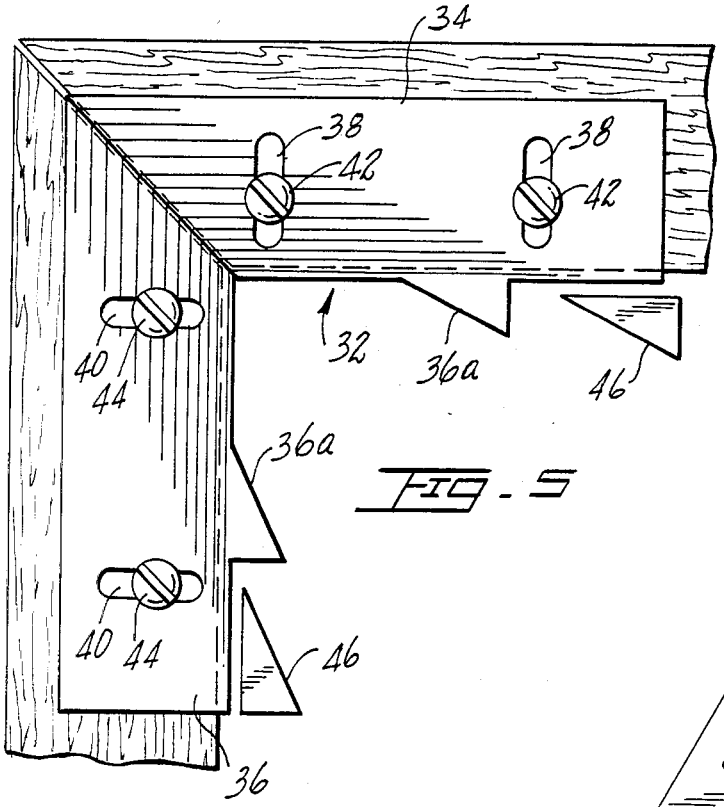
FIG. 5
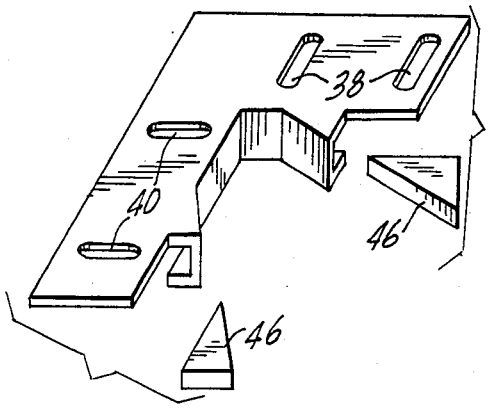
FIG. 6A.
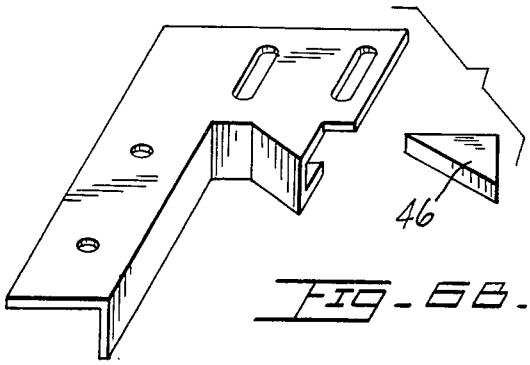
FIG. 6B.
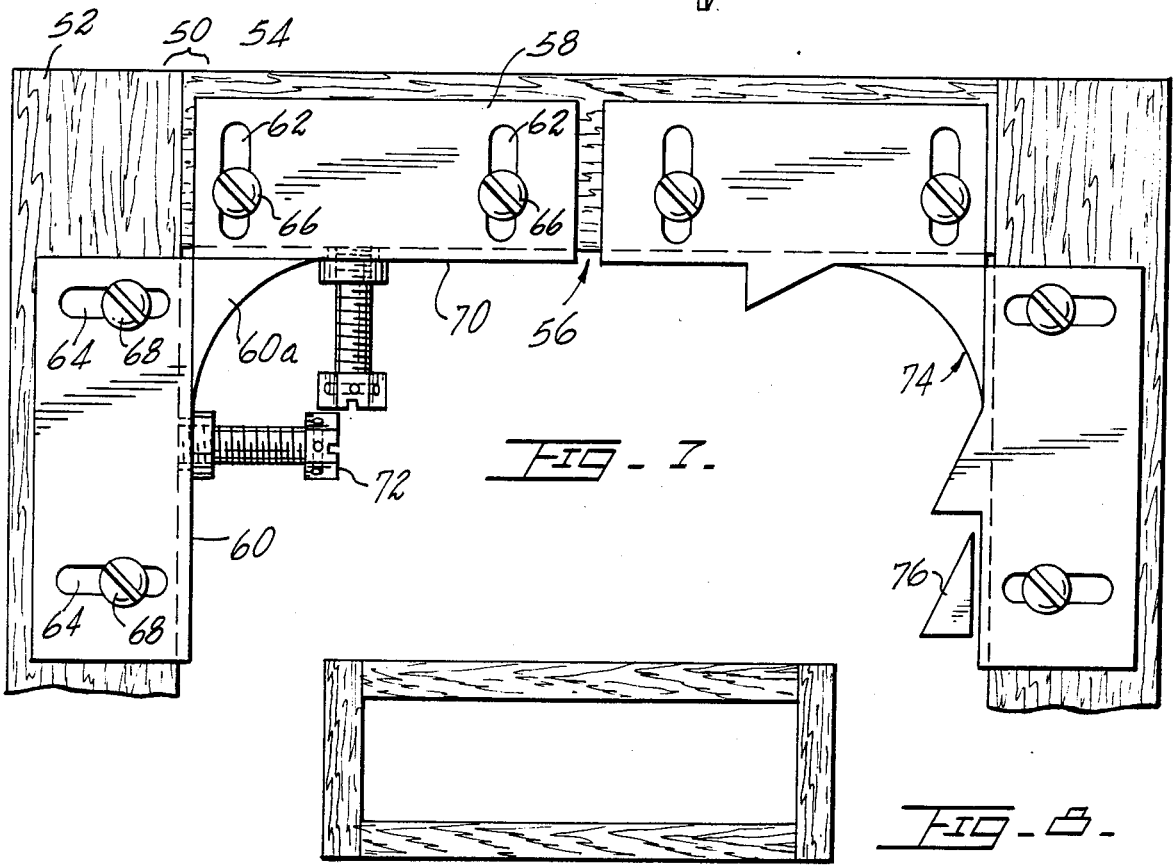
FIG. 7.
FIG. 8.

FABRIC STRETCHING DEVICE

BACKGROUND OF THE INVENTION

1. Other Related Applications

The present application is a continuation-in-part of U.S. patent application No. 06/263,782 filed on May 14, 1981, now abandoned.

2. Field of the Invention

The present invention relates to fabric stretchers for painting canvas mounted on wooden frames, and more particularly, to a device that provides for mechanical tensioning to achieve precise stretching of the canvas in two directions, independently, and at the same time separates the canvas from the frame.

3. Description of the Prior Art

Corner joint spreaders have been used with works of art to stretch canvas for centuries. Various devices as employed heretofore have suffered many deficiencies, and have proven to be quite unsatisfactory.

Achieving uniform tension at all points on the canvas as it is mounted on the stretcher is an objective. Delicate, yet firm tensioning adjustment is required at many points around the stretcher members, especially at the corner joints.

Most canvas frames have four rigid peripheral members joined at their respective ends to form a square or rectangle. The end joints are either mitered, butt-end, or an interlocked mitered configuration. Additional longitudinal or lateral cross support members may be included. After the fabric (which is normally canvas) is secured in tension around the frame periphery, adjustments are made at the corner joints and cross support members to insure uniform tension in both length and width across the canvas. Ideally, the frame member surfaces, which directly face the canvas on the canvas side, are angled inwardly or lean inwardly so that the canvas is stretched, tensioned and contacted only along the outer corner edge of each member so that the canvas does not touch or engage the entire surface of the stretcher member. Frame members are usually constructed in standard lengths (whole number series) so that utilizing fractional lengths required with some canvas sizes cannot be achieved without adjustment.

One of the attempts to solve the above mentioned problems of the industry is disclosed in U.S. Pat. No. 3,012,362 issued to S. L. Blinderman. Here, a wedge is inserted into a corner joint separating the two members that form the corner joint simultaneously. Also, this device would only operate with mitered corner joints and not with butt-ends. Finally, Blinderman's device does not separate the canvas from the frame as in the present invention.

Another device designed to stretch a painting canvas is disclosed in U.S. Pat. No. 602,353 issued to Nunns. This device uses elongated slots, however, these slots are 90 degrees apart from the ones used in the present invention. Also, Nunns' device needs groove "a" which is not required in the present invention. Finally, like in Blinderman, Nunns' does not separate the canvas from the abutting surface of the frame.

Another tensioning or stretching device is disclosed in U.S. Pat. No. 1,562,153 issued to Elbern which utilizes wedges "b" and/or screw members "f" counteracting nails "d" and "e". This stretcher weakens the frame when wedges "b" and/or screw members "f" are adjusted. Again, Elbern does not separate the canvas from the frame.

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide a stretching device for fabric that is mounted on a rectangular frame.

It is another object of the present invention to provide a fastening device for holding together a rectangular frame comprising four structural members on which a fabric is mounted, and it is a further object to provide such a fastening and stretching device for use with structural members having butt-end corners which are less expensive and easier to manufacture.

It is still another object of the present invention to provide a device that is capable of stretching the canvas on a frame in two directions, independently.

Yet another object of this invention is to provide a stretching device that will separate the fabric from the flat surfaces of the frame members over which it is mounted.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 5 shows a front elevational view of an alternate embodiment of the present invention attached to the back corner of a fabric stretcher frame.

FIG. 6A shows a perspective view of the embodiment for a T-shape joint.

FIG. 6B shows yet another alternate embodiment of the embodiment shown in FIG. 5 and a perspective view.

FIG. 7 shows yet another alternate embodiment in a front elevational view of the invention mounted on the back of a fabric stretcher that has butt-end corner joints in lieu of mitered corner joints.

FIG. 8 shows a back elevational view of the fabric stretcher shown in FIG. 7.

DETAILED DESCRIPTION OF THE PREFERRED EMBODIMENT

Figure 1:
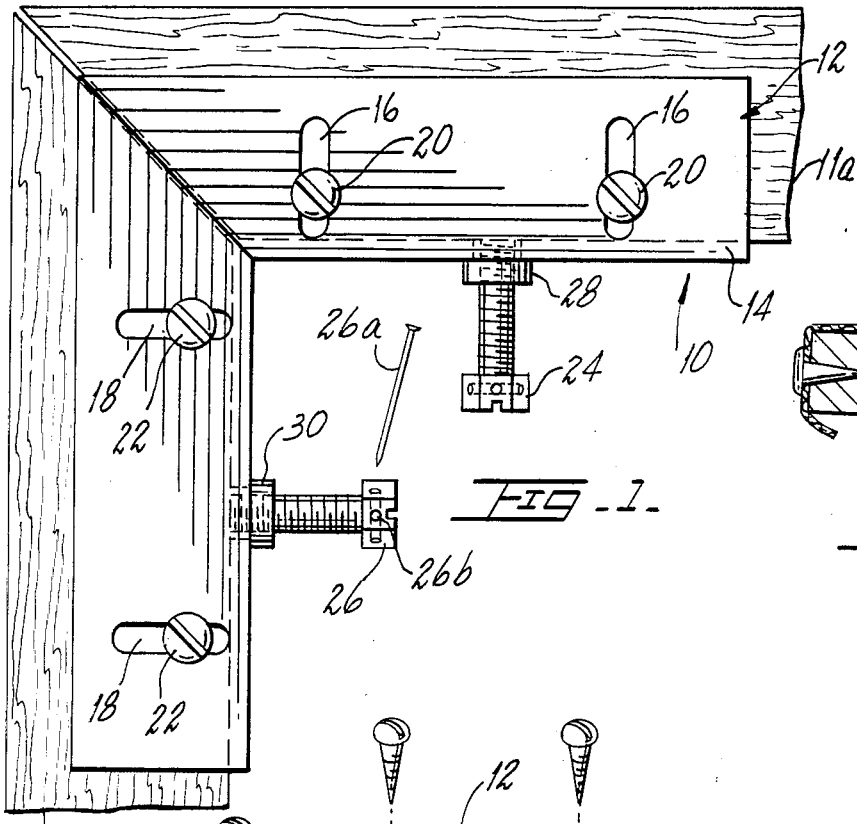
FIG. 1 shows a front elevational view of one embodiment of the present invention attached to the back side of one corner of a fabric stretcher frame (the side opposite the canvas or fabric).

Referring now to the drawings and specifically FIG. 1, the present invention is shown generally at 10 mounted on the backside at a corner joint between two fabric or canvas stretching frame members 11*a* and 11*b* which are joined together by a mitered corner joint at 11*c*. Looking at FIGS. 1 and 2, the embodiment 10 includes a first rigid L-shaped wall 12 that occupies a single plane connected to a second rigid wall structure 14 that has an L-shaped cross-section and extends from the inner edge of wall 12 to a plane perpendicular to wall 12. The two are joined integrally together to form essentially a pair of right angle channels that intersect at a corner joint. The channels are used to receive the corner rectangular inner edges of fabric frame members 11*a* and 11*b*. In the preferred embodiment, device 10 is made out of metal.

The device 10 also includes in wall 12 a pair of elongated slots 16 and 18 which cooperate with holes (not shown) in frame members 11*a* and 11*b* as is further discussed below. Each of the elongated slots 16 and 18 receive screws 20 and 22 which comprise threaded fasteners that mount on frame members 11*a* and 11*b* in FIGS. 1 and 2.

L-shaped wall section 14 on the inside of the frame members 11*a* and 11*b* include a pair of threaded apertures 28 and 30 that receive bolts 24 and 26 which are also threaded. FIG. 1 also shows a rod-like element 26*a* which may be a small nail that can fit in a small hole in the bolt head such as hole 26*b*. This is used as lever to rotate bolts 24 and 26.

Figure 2:
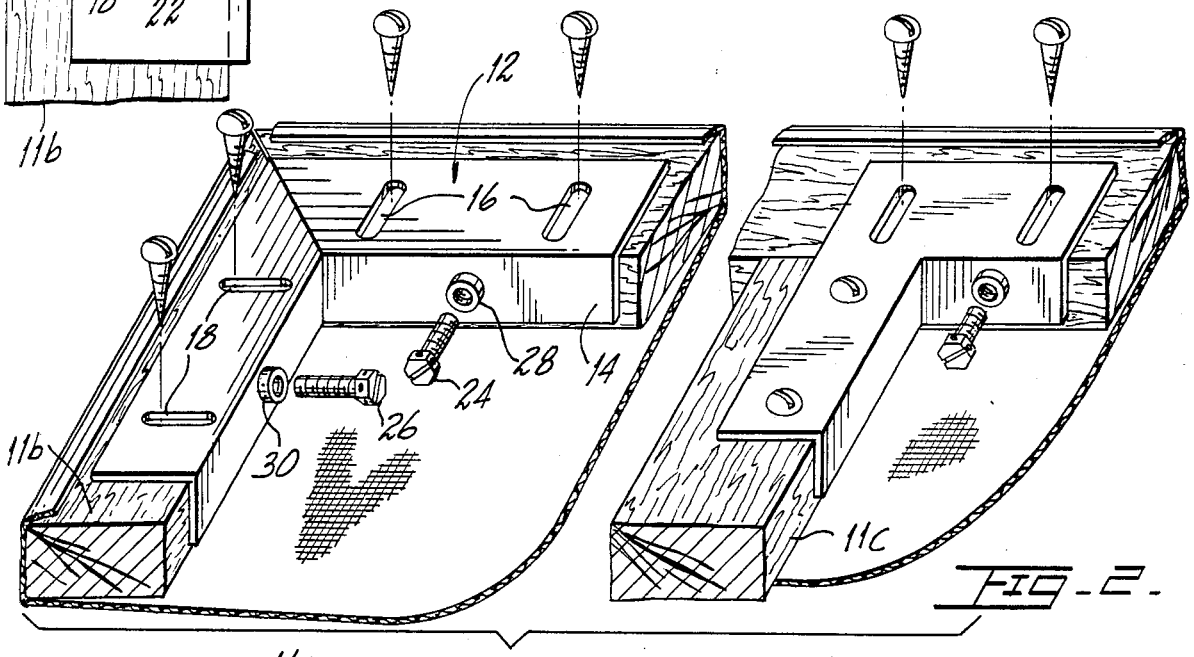
FIG. 2 shows a perspective view of the embodiment of FIG. 1 and an alternate embodiment of FIG. 1 used for T-shape joints of structural members of long frames.
Figure 3:
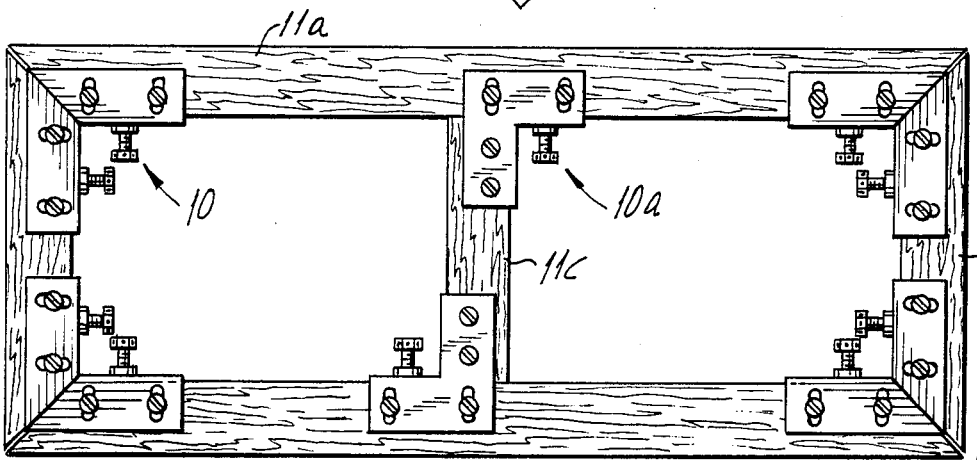
FIG. 3 shows a front elevational view of several embodiments of the present invention disposed on the back side of a fabric stretcher frame.

In addition to stretching the fabric or canvas attached to the members 11*a* and 11*b* at a corner joint, a modified embodiment of the device shown in FIG. 2 adapted for T-shaped joints may be accommodated such as that shown in the center of the fabric stretcher shown in FIG. 3 and referred to generally by 10*a*. The device 10*a* can be used for stretching fabric as between members 11*a* and 11*c* which is a center frame support member. Device 10*a* does not require elongated holes on both portions of its L-shape walls since only the peripheral member would be stretched.

To operate the device shown in FIG. 1, one of the threaded fasteners 22 or 20 is loosened to allow movement of the fabric stretcher members 11*a* or 11*b* relative to the device 10. Then, tensioning bolt 24 or 26 is rotated inwardly forcing member 11*a* or 11*b* that it engages outwardly to tension the fabric attached thereto. Each one of the frame members is adjusted separately and independently.

Figure 4A:
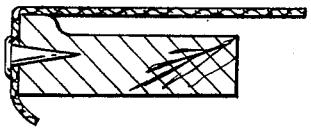
FIG. 4A shows cross-sectional views of one side of a conventionally recessed fabric stretcher frame member and representative fabric or canvas mounted thereto with nails.
Figure 4B:
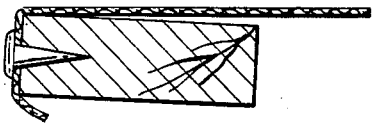
FIG. 4B shows the position achieved in relation to the canvas by using the present invention with an inexpensive unworked flat frame member.
Figure 9:
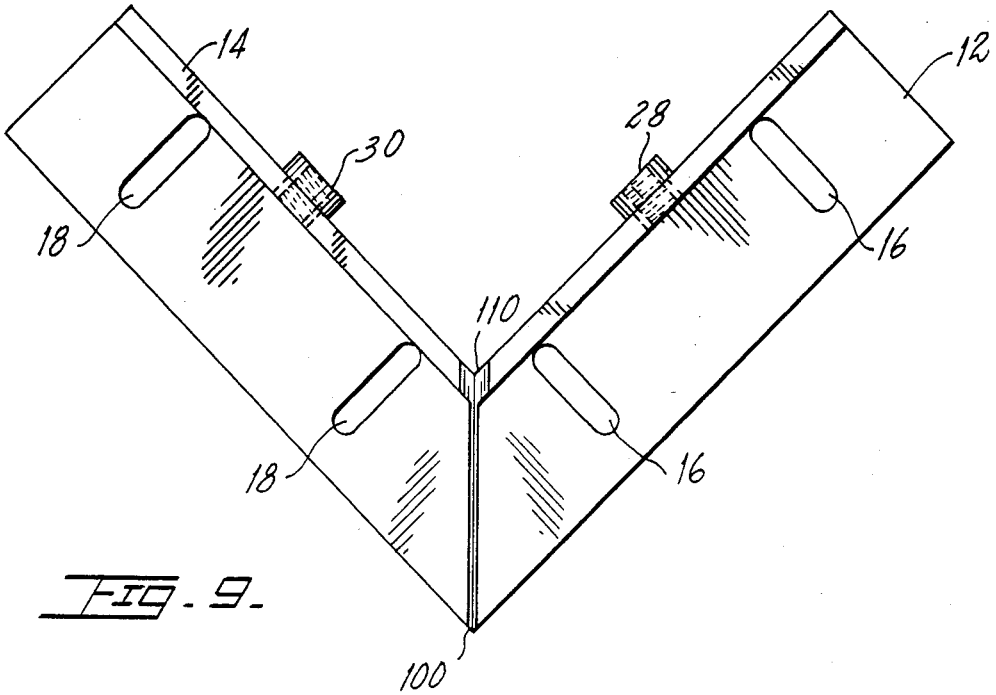
FIG. 9 represents an imaginary underside view of the fabric stretching device, resting on a planar surface, with its corner separated.
Figure 10:
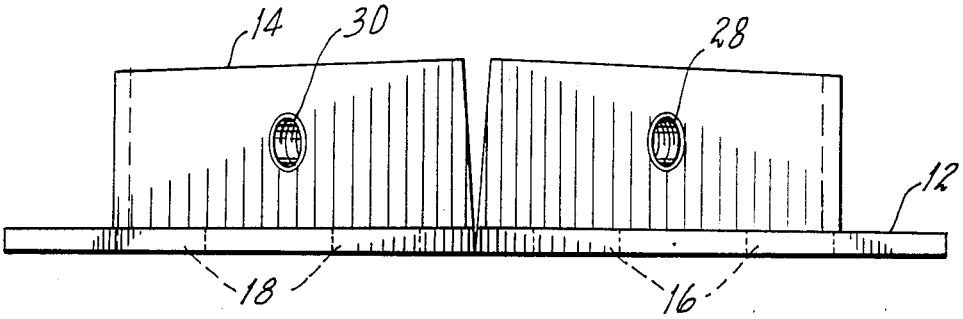
FIG. 10 is the same imaginary device shown from the side, to show the separation between the two portions of the device if it were forced to be adjacent to a planar surface.
Figure 11:
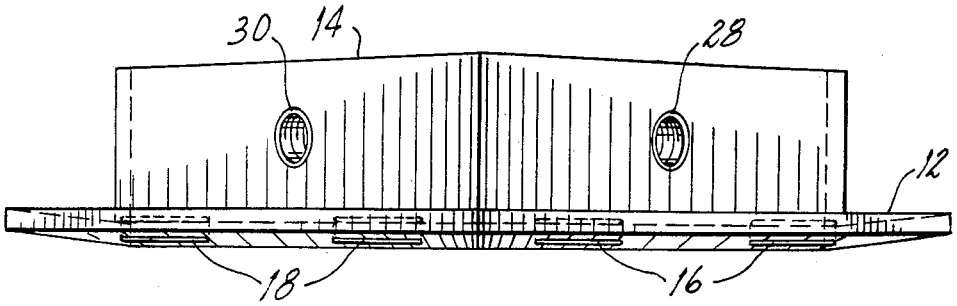
FIG. 11 represents the device subject of the present application as it is seen from the same direction as in FIG. 10, showing the peak roof effect so that the effect shown in FIG. 4B is provided.

In FIG. 4A, a cross section of a conventional frame peripheral member is shown having a recessed surface 15. This is done so that the fabric or canvas 11 is separated for the structural frame members thereby avoiding marking the painting on the canvas. However, these recesses make the frame members more expensive. Also, the manufacturers only have available a number of standard machine-made wedge frames with interlocking mitered corner joints. The present stretcher devices 10 and 10*a* are capable of being used with flat, unworked wooden members and achieve the canvas separation shown in FIG. 4B. It is one of the novel and important features of the present invention to provide the separation of the canvas from the adjacent surface of the frame member, as seen in FIGS. 2 and 4B. In order to facilitate the understanding of the shape required of device 10, FIGS. 9 and 10 show a wooden prototype device as it is allowed to rest on a planar surface, without joining its corner. L-shaped member 14, as seen in FIG. 9, has a beveled groove at 110 and outer corner 100 which may also be appreciated from FIG. 10. When the two leg portions of member 14 are joined together and the groove closed, the device shown in FIG. 11 results. It is to be noted that the angle between the surfaces of members 12 and 14 is still 90 degrees. However, it can be observed that the bottom surface of member 12 is no longer parallel to the surface where it is resting. Member 14 still has an L-shaped cross-section and member 12 will still have an L-shape but it will not lie on a flat surface. Rather, the two component portions of the "L" will have an angle slightly less than 180 degrees. This small angular inclination is critical since it will cause the frame member being stretched to conform to this angular inclination when either fastening means 20 or 22 are tightened, thereby separating the frame member in question from the canvas, as represented in FIG. 4B.

Since device 10 will act as a fastening device for the corner joints, the frame members may be cut to any size. This provides the flexibitily of not having to be constrained to certain standard commercial sizes. Also, the corner joints do not need to be mitered or cut in any other special way. Device 10 will work with simple butt-end joints.

In FIGS. 5, 6A and 6B an alternate embodiment is shown where a wedge 46 is used to provide the tensioning effect produced by bolt 24 in FIG. 1. Wedge 46 slides inside the built-in triangular compartment 36A.

A slightly modified embodiment, shown in FIG. 7, may be used for frames with butt-end corners. A reinforcing corner member 60*a* is provided to further insure the structural stability of the device. Also, the corner of the modified embodiment shown in FIG. 7 has been cut off so that frame members 52 and 54 can be stretched without interfering with the slight angle of walls 58 and 60 with respect to the adjacent flat surfaces of members 52 and 54 against which device 56 engages.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A stretching device for independently stretching fabric or canvas mounted on a stretcher frame in two directions, perpendicular to each other, comprising:

A. a first L-shaped rigid and flat support member for engaging adjacent structural members of said frame forming a corner joint and having apertures for fastening means connectable through said apertures to the adjacent engaged structural frame member for rigidly securing said first support member in place with respect to said adjacent engaged frame member;

B. a second rigid support member having an L-shape cross-section integrally built on the inner edge of said first support member and extending perpendicularly from it so that said second support member engages the inner walls of the adjacnet members engaged by said first support member, whereby said first and second support members comprise a pair of right angle channels that intersect at a corner joint;

C. a beveled groove located at said corner at said corner joint and extending from the outside corner of said first support member to the inside corner of said second support member and of such a depth therethrough whereby that when the two legs of said first support member are joined together thereby closing the groove therebetween, the bottom surfaces of said leg portions are inclined at an angle of slightly less than 180 degrees so that when said fastening means are tightened the surfaces of said structural frame members adjacent to the canvas are caused to separate from it;

D. and tensioning means mountable in said second support member for engaging the adjacent frame member for movement in a direction parallel to its corresponding elongated aperture, whereby said device may be placed on a corner joint of said frame and each structural member may be separately tensioned by loosening its corresponding apertures, activating said tensioning means and thereafter tightening said fastening means to fix the position of the frame members.

2. The device set forth in claim 1 wherein said tensioning member includes a rigid wedge-shaped block and said second right support member having at least one wedge-shaped compartment for said wedge-shaped block on each portion so that when said block is driven in said wedge-shaped compartment forces the adjacent stretcher frame member to tension the canvas attached thereto.

3. The device set forth in claim 1 said tensioning member includes a threaded bolt and second rigid support member includes a compatible threaded hole for receiving said bolt so that when said bolt is driven in forces the adjacent stretcher frame member to tension the canvas attached thereto.

* * * * *